US008369532B2

(12) United States Patent
Aarts

(10) Patent No.: US 8,369,532 B2
(45) Date of Patent: Feb. 5, 2013

(54) DEVICE FOR AND A METHOD OF PROCESSING AN AUDIO SIGNAL

(75) Inventor: Ronaldus Maria Aarts, Geldrop (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 706 days.

(21) Appl. No.: 12/376,450

(22) PCT Filed: Aug. 7, 2007

(86) PCT No.: PCT/IB2007/053098

§ 371 (c)(1),
(2), (4) Date: Feb. 5, 2009

(87) PCT Pub. No.: WO2008/018012

PCT Pub. Date: Feb. 14, 2008

(65) Prior Publication Data

US 2010/0166190 A1 Jul. 1, 2010

(30) Foreign Application Priority Data

Aug. 10, 2006 (EP) ..... 06118748

(51) Int. Cl.
*H04R 5/00* (2006.01)

(52) U.S. Cl. ..... 381/1; 381/10; 381/11; 381/13; 381/22

(58) Field of Classification Search ..... 381/22, 381/17, 18, 13, 1–2, 10–11, 98, 103, 86
See application file for complete search history.

(56) References Cited

U.S. PATENT DOCUMENTS

| | | | | |
|---|---|---|---|---|
| 3,825,684 | A * | 7/1974 | Ito et al. | 381/22 |
| 3,849,600 | A | 11/1974 | Ohshima | |
| 5,701,345 | A | 12/1997 | Howlett et al. | |
| 5,703,953 | A * | 12/1997 | Otoguro | 381/12 |
| 5,742,687 | A | 4/1998 | Aarts | |
| 6,606,388 | B1 * | 8/2003 | Townsend et al. | 381/17 |

FOREIGN PATENT DOCUMENTS

| | | | |
|---|---|---|---|
| WO | 8706090 | A1 | 10/1987 |
| WO | 9119407 | A1 | 12/1991 |
| WO | 9821915 | A1 | 5/1998 |

OTHER PUBLICATIONS

Sawada Hiroshi, et al; "A Robust and Precise Method for Solving the Permutation Problem of Frequency-Domain Blind Source Separation," IEEE Trans. Speech and Audio Processing, vol. 12, No. 5, Sep. 2004, pp. 530-538.

* cited by examiner

*Primary Examiner* — Steven Loke
*Assistant Examiner* — Cuong Nguyen

(57) ABSTRACT

A device for processing an audio signal, wherein the device comprises a detection unit adapted for detecting a widening state of the audio signal, and a widening modification unit adapted for modifying a widening characteristic of the audio signal depending on the detected widening state of the audio signal.

18 Claims, 2 Drawing Sheets

DEVICE FOR AND A METHOD OF PROCESSING AN AUDIO SIGNAL

FIELD OF THE INVENTION

The invention relates to a device for processing an audio signal.

Beyond this, the invention relates to a method of processing an audio signal.

Moreover, the invention relates to a program element.

Furthermore, the invention relates to a computer-readable medium.

BACKGROUND OF THE INVENTION

Audio playback devices become more and more important. Particularly, audio systems comprising audio manipulating features become more and more important.

U.S. Pat. No. 5,742,687 discloses a signal combining circuit having a first input and a second input for receiving signals which have frequencies in the audio frequency spectrum, and an output. A first signal path between the first input and the output has a first transfer characteristic. A second signal path between the second input and the output has a second transfer characteristic. The transfer characteristics are different which causes a phase shift to occur between signal components passed through the first signal path and signal components passed through the second signal path. The amplitude transfer determined by the transfer characteristics decreases above a predetermined frequency. There is a phase difference between phase transfer characteristics which decreases with frequency. For frequencies below the predetermined frequency the amplitude transfer determined by the first transfer characteristic exceeds that determined by the second transfer characteristic. By interconnecting the first input and the second input, the amplitude transfer between the interconnected inputs and the output as a function of frequency is substantially constant. The signal combining circuit is used in a stereophonic audio reproduction system to enhance the stereo image. The stereophonic audio reproduction system can form part of an audio-visual reproduction system.

However, it may happen with conventional audio playback systems that the audio playback quality is not satisfactory.

OBJECT AND SUMMARY OF THE INVENTION

It is an object of the invention to provide an audio system having a proper audio playback quality.

In order to achieve the object defined above, a device for processing an audio signal, a method of processing an audio signal, a program element and a computer-readable medium according to the independent claims are provided.

According to an exemplary embodiment of the invention, a device for processing an audio signal is provided, wherein the device comprises a detection unit adapted for detecting a widening state of the audio signal, and a widening modification unit adapted for modifying a widening characteristic of the audio signal depending on the detected widening state of the audio signal.

According to another exemplary embodiment of the invention, a method of processing an audio signal is provided, wherein the method comprises detecting a widening state of the audio signal, and modifying a widening characteristic of the audio signal depending on the detected widening state of the audio signal.

According to yet another exemplary embodiment of the invention, a computer-readable medium is provided, in which a computer program of processing audio data is stored which, when being executed by a processor, is adapted to control or carry out a method having the above mentioned features.

According to still another exemplary embodiment of the invention, a program element of processing audio data is provided, which program element, when being executed by a processor, is adapted to control or carry out a method having the above mentioned features.

Signal processing and audio manipulation for improving audio playback quality which may be performed according to embodiments of the invention can be realized by a computer program, that is by software, or by using one or more special electronic optimization circuits, that is in hardware, or in hybrid form, that is by means of software components and hardware components.

The term "widening" may particularly denote an audio signal processing scheme according to which an audio signal is manipulated to obtain a specific audio effect, particularly an altered stereo effect. More particularly, a stereo widener (or a stereo enhancer) may be provided which may allow to manipulate (particularly enhance) a stereo characteristics, as perceived by a human listener, by extracting stereo and mono components and manipulate components for instance in time and/or space. For example, differences between a left channel and a right channel may be emphasized by such a manipulation. "Widening" may denote a virtual broadening of a loudspeaker base to emphasize (or to weaken) a stereo effect.

The term "modifying the widening characteristic" may particularly denote applying a manipulation scheme to the signal that selectively widens or narrows (that is unwidens) the signal. For example, a previously widened signal may be narrowed, and/or a previously narrowed signal may be widened. By taking this measure, it may be possible to recover an original audio signal characteristic. The modification of the widening characteristic may therefore include a positive widening or a negative widening.

The term "blind separation algorithm" or blind signal separation, also known as blind source separation, may particularly denote any algorithm related to the separation of a set of signals from a set of mixed (correlated or uncorrelated) signals, without the aid of information (or with very little information) about the nature of the signals. Examples are the principal components analysis, singular value decomposition, independent component analysis, dependent component analysis, or non-negative matrix factorisation.

According to an exemplary embodiment, an audio processing scheme may be provided in which an input audio signal is analyzed with regard to a possible previously performed stereo widening operation. In case of detecting that an instance or entity located upstream in the signal processing part (for instance a separate CD player or a remote TV station) has already performed a signal widening, this widening may be compensated for partially or entirely, to thereby make the signal fit to a further selective signal manipulation (for instance another widening procedure) without deteriorating of the audio quality. Therefore, an inverse widening (or inverse unwidening) procedure may be carried out, allowing to bring back the signal entirely or partially in a state in which another signal manipulation can be carried out without disturbing the signal quality.

Therefore, exemplary embodiments of the invention may allow for a cancellation of a stereo-base widening, in order to improve accuracy and quality of the audio signal.

A stereo-base widening may be used in a lot of consumer products like television and stereo sets. Such a stereo widening system may make it appear that the loudspeakers are placed further apart than they are in reality. This may give a better listening performance to the consumer. Recently, media broadcasters have started to broadcast their programs with a stereo widening already applied. In case the consumer has a TV with a stereo widening applied, this results in a cascading of the stereo widening system and a deterioration of the listening performance.

According to an exemplary embodiment, such problems may be overcome by providing a system that resolves the original audio signal that is the signal without the stereo widening applied. This may make it possible to apply the stereo widening the way the consumer wants.

The stereo widening system may be a digital signal processing system. It may comprise certain structures that filter the original audio signal. It has been recognized that it is possible that the stereo widening system can be inverted, when it is known that stereo widening is applied in all further information: The amount of widening, the filter structure, and the filters, is known. Furthermore, it has been recognized that it is possible to resolve the original signal when all information about the widening system, except the amount of widening, is known. However, it may also be possible that the original signal may be resolved in case that only the filter structure is known. Furthermore, it may be possible to resolve the system without anything known about the system.

Wideners may be used in tandem, that is to say an undesirable cascading of widener building blocks may occur, for instance if stereo signals have been widened already in a TV studio, on a CD, any other storage medium, or transmission channel and a widener is used again, for instance in a (for example portable) audio set or TV set. Cascading of those wideners may be in generally an undesired situation, resulting in a poor audio quality.

In order to overcome such a problem, an exemplary embodiment of the invention relates to an audio processing unit adapted for widening an audio input signal. Such an audio processing unit may comprise an input for receiving the audio input signal, a widening unit adapted for widening the audio input signal yielding an output signal, and a control unit adapted to provide a widening control signal representative of a widening state of the audio input signal. The widening unit may be adapted for widening the audio input signal based on the widening control signal.

Exemplary embodiments of the invention may have the advantage that it may be possible to detect the widening and to (partially or entirely) undo it, or, to inhibit the next widener, resulting in a better sound quality.

Thus, according to an exemplary embodiment, an automatic control of stereo base width may be made possible. Cascading of stereo base wideners may be enabled without signal deterioration.

Stereo base wideners are in use. One particular form is known as the Incredible Surround system of Philips. Wideners may be used to give a virtual widening between the loudspeakers, which is appreciated if the loudspeakers are close together, such as in TV sets and portable audio sets. Conventionally, a problem may arise if a stereo signal has been widened already, for instance in a TV studio, on a CD, and a widener is used again, for instance in an audio set or TV set (or in any other particularly portable device). An example is that a TV broadcaster may widen the signal more than others, which may be annoying even without a cascaded second widener, since the sound image changes during channel switching (zapping) in an annoying way.

According to an exemplary embodiment of the invention, the widening may be altered, for instance by complete undoing the widening. Another application is to alter the widening into another widening effect. It is possible to first undo the widening and then alter it by applying a new widening.

According to another exemplary embodiment, the last two procedures can be combined in one. The necessary filters may be calculated and appear reliable and stable. Also the order of widening and undoing this may be interchanged.

Next, further exemplary embodiments of the device for processing audio data will be explained. However, these embodiments also apply for the method, for the program element and for the computer-readable medium.

The detection unit may be adapted for detecting whether the audio signal has previously been widened (or narrowed) or not. In other words, it may be detected by an analysis of the audio signal whether a widening (or narrowing) procedure or algorithm has beforehand been applied to the audio signal, for example before the audio signal has been supplied to the device. This can be performed with a simple "Yes/No" estimation, or also in a gradual manner.

For the latter case, it is possible that the detection unit detects a widening parameter indicative of a degree to which the audio signal has previously been widened, for example of an instance located upstream (with regard to a signal processing path) of the device. Such a widening parameter (which may also be denoted a according to exemplary embodiments) may have a range of values, for example may range from 0 to 1 wherein this parameter value may indicate a degree of widening. This may allow characterizing the previously applied widening with increased accuracy.

The detection unit may be adapted for detecting the widening state of the audio signal based on a blind separation algorithm. By applying such an algorithm, it may be possible to detect the widening state with high accuracy and with low effort, making use of already developed algorithms, which beforehand have been used for other purposes.

The detection unit may be adapted for detecting the widening state of the audio signal based on information of the audio signal itself and/or external information. In other words, the detection unit may use (exclusively) the audio signal itself to derive information with regard to its widening properties (for example performing a blind signal separation). Alternatively, the detection unit may use (exclusively) external information to derive information with regard to the widening properties of the audio signal. Such external information may be taken from the Internet, from the audio content source (like a CD), from a database, using expert knowledge or empiric knowledge, etc. Analyzing such external information (wherein the term "external" may denote information which does not belong to the audio signal itself) may allow to improve the knowledge with regard to frame conditions (for instance a way according to which audio content stored on a CD has been recorded), which may allow to derive information whether a previous widening of audio data is likely or not. Further alternatively, the detection unit may use both audio data and external information to derive information with regard to the widening properties of the audio signal.

The widening modification unit may be adapted for widening (or narrowing) the audio signal in a manner to be at least partially, particularly to completely, undue a previously performed widening (or narrowing) when the detected widening state indicates that the audio signal has previously been widened or narrowed. In other words, the widening modification unit may bring back the audio signal in its initial or original shape in which it has been before the first widening algorithm has been applied to the audio signal, for instance by a remote audio component to which the device is connected (for instance a CD player or a connected TV station). After the signal has been brought back to its original state, a specific desired (for instance user-controlled) widening algorithm may be applied by the device, without deteriorating the audio signal due to a non-desired cascading of two widening procedures. However, two separate units or devices may perform both the process of undoing a previous external widening and performing a desired internal widening. Alternatively the two separate units may be adapted as one single unit or device having both capabilities.

The widening modification unit may be adapted for altering a widening or narrowing property of the audio signal when the detected widening state indicates that the audio signal has previously been widened or narrowed. Therefore, such an embodiment may simply modify the widening characteristics without completely undoing a previous widening and performing a subsequent altered widening.

The widening modification unit may be adapted for inhibiting the audio signal from widening or narrowing when the detected widening state indicates that the audio signal has previously not been widened or narrowed. Therefore, when it is determined that no widening has been performed before inputting the audio signal to the device, the widening modification unit simply does nothing or omits a manipulation, that is to say allows the audio signal to pass without modification. By taking this measure, it may be securely prevented that an undesired unwidening procedure is carried out, even in a case in which no previous widening has occurred.

The device may comprise a further or an additional (separate) widening modification unit which is provided separately from the above-mentioned widening modification unit, and which may be adapted for widening the audio signal processed by the widening modification unit. Therefore, a cascading of widening modification units may be realized, however without the above-mentioned problems. Namely, the undoing of the previously performed widening (or narrowing) by the first widening modification unit may bring back the signal into its initial state, wherein the further widening modification unit may then perform any desired widening procedure.

The widening modification unit may be realized using at least one filter, that is to say an audio component that allows passing audio of specific frequency and/or amplitude ranges, whereas other audio contribution may be suppressed or eliminated by filtering.

The widening modification unit may be adapted to perform, selectively, one of the group consisting of stereo widening and stereo narrowing. In other words, widening does not necessarily mean that the stereo character of an audio signal is increased, but also a decrease of such a characteristics is possible, which may then be denoted as stereo narrowing.

The device may comprise a plurality (two or more than two) of audio playback devices adapted to play back the processed audio signal. Such audio playback devices may comprise loudspeakers, headsets, etc. and may allow playing back the processed audio signal to be audible by a human listener. Particularly, when the distance between the audio playback devices is small, widening may be desired to improve the perceived audio quality.

The audio signal may be a multiple audio channel signal, particularly a stereo signal. The term "stereo signal" may particularly denote the fact that the audio signal has two components; each component intended to be reproduced by a different loudspeaker, thereby generating a stereo effect or any other spatial acoustic perception. When the audio signal is a stereo signal, widening may be particularly appropriate to improve the subjective quality of the perceived audio. However, the multiple audio channel signal may also comprise more than two audio signals, for instance in a 5.1 system, denoting an audio format utilizing three primary channels (left, center, right), two surround channels (left surround, right surround) and an LFE channel, which is the "0.1" channel because it may use approximately one-tenth of the bandwidth of a full-frequency channel. Audio surround systems may have embodiments of the invention implemented therein.

The device for processing audio data may be realized as at least one of the group consisting of a portable audio player, a loudspeaker, an audio surround system, a mobile phone, a headset, a loudspeaker, a hearing aid, a handsfree system, a television device, a TV set audio player, a video recorder, a monitor, a gaming device, a laptop, an audio player, a DVD player, a CD player, a harddisk-based media player, an internet radio device, a public entertainment device, an MP3 player, a hi-fi system, a vehicle entertainment device, a car entertainment device, a medical communication system, a body-worn device, a speech communication device, a home cinema system, a home theater system, an audio server, an audio client, a flat television apparatus, an ambiance creation device, and a music hall system.

However, although the system according to an embodiment of the invention primarily intends to improve the quality of sound or audio data, it is also possible to apply the system for a combination of audio data and visual data. For instance, an embodiment of the invention may be implemented in audiovisual applications like a video player or a home cinema system in which one or more speakers are used.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
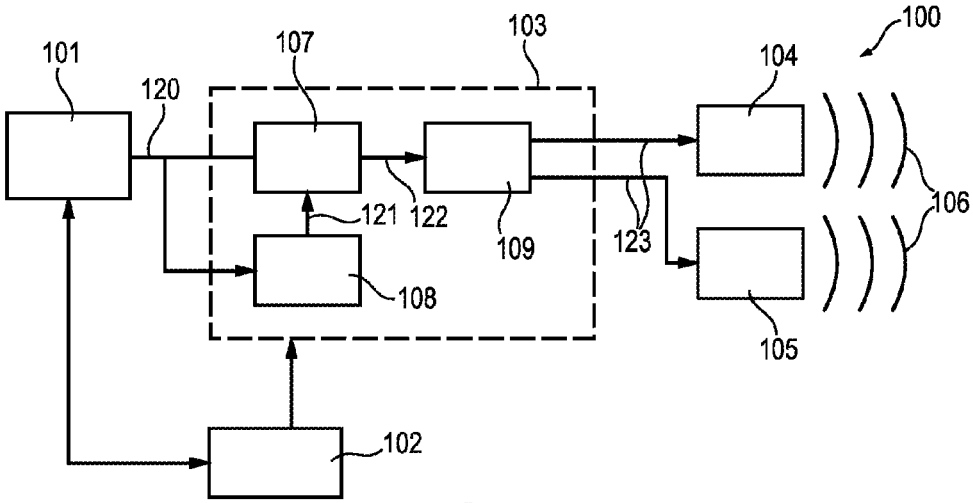
FIG. 1, FIG. 5 to FIG. 9 illustrate devices for processing an audio signal according to exemplary embodiments of the invention.

The illustration in the drawing is schematically. In different drawings, similar or identical elements are provided with the same reference signs.

In the following, referring to FIG. 1, a device 100 for processing an audio signal 120 according to an exemplary embodiment of the invention will be explained.

The device 100 comprises an audio content source 101, for instance a CD player, a harddisk, or a connection to a remote TV station providing the audio signal 120. Within the audio content source 101, any pre-processing of the audio data can occur, particularly any widening algorithm may be applied for instance to enhance a stereo effect of the audio signal 120.

As can be taken from FIG. 1, a user interface 102 is provided which enables to bidirectionally communicate with the audio data source 101. The user input/output device 102 allows a human user to provide instructions concerning the operation of the device 100. The user input/output device 102 may comprise a display unit like an LCD, a TFT, or a cathode ray tube monitor. Furthermore, input elements may be foreseen in the user input/output device 102, comprising for instance a keypad, a joystick, buttons, a trackball and/or a microphone of a voice recognition system.

FIG. 1 further shows an audio processor 103 (for instance a central processing unit or a microprocessor). The processor 103 may perform the necessary calculation procedures for the operation of the device 100.

The device 100 comprises a detection unit 108 adapted for detecting (for instance by blind signal separation) a widening state of the audio signal 120. After an analysis of the audio signal 120 with regard to a possibly previously performed widening in the audio data source 101, the detection unit 108 generates a control signal 121 which controls a widening modification unit 107 adapted for widening (or narrowing) the audio signal 120 in accordance with the detected widening state of the audio signal 120.

Particularly, the detection unit 108 detects whether the audio signal 120 has previously been widened or not in the unit 101. As an alternative to such a "digital" decision (in other words Yes/No), the detection unit 108 may also be adapted for detecting a widening parameter a indicative of a degree to which the audio signal 120 has previously been widened. The detection unit 108 may also be denoted as a blind separation block 108 which carries out a blind separation algorithm, in order to determine the widening state.

Based on the control signal 121, the widening modification unit 107 may undo the previously performed widening (performed by the audio data source 101) at least partially, when the detected widening state indicates that the audio signal 120 has previously been widened. Alternatively, the widening modification unit 107 may inhibit the audio signal 120 from being widened by the unit 107 when the detected widening state indicates that the audio signal 120 has previously not been widened in unit 101. In other words, the unit 107 eliminates or reduces a possibly performed previous widening.

A further widening modification unit 109 is shown to which an intermediate signal 122 is supplied. The intermediate signal 122 is supplied at an output of the widening modification unit 107. The further widening modification unit 109 widens the audio signal 122 processed by the widening modification unit in any desired manner, for instance in accordance with a user-defined adjustment input via the input/output device 102.

At an output of the further widening modification unit 109, output audio signals 123 are provided which are supplied to inputs of a first loudspeaker 104 and of a second loudspeaker 105 which then emit audio waves 106 as a stereo signal.

Summarizing, since the widening modification unit 107 undoes the widening previously performed to the audio signal 120, and therefore generates an unwidened audio signal 122, provisions are made that a subsequently connected additional widening modification unit 109 can apply any desired widening algorithm, without deteriorating the quality of the signal 122, 123.

In the following, a conventional system will be explained in order to provide a further detailed understanding of exemplary embodiments of the invention.

Stereo base wideners are in use (see R. M. Aarts, "Phantom Sources Applied to Stereo-Base Widening", J. Audio Eng. Soc., 48, 3, pages 181-189, or see U.S. Pat. No. 5,742,687). One particular form is known as the Incredible Surround system of Philips. Wideners are used to give a virtual widening between the loudspeakers, which is appreciated if the loudspeakers are close together, such as in TV sets and portable audio sets.

Figure 2:
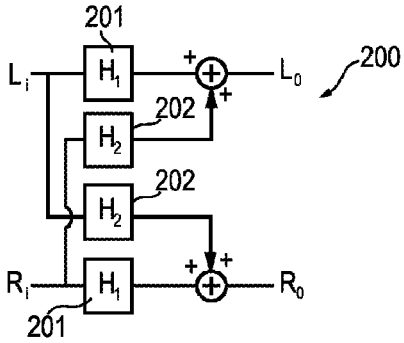
FIG. 2 to FIG. 4 illustrate devices for processing an audio signal.

FIG. 2 shows a set-up 200 of a stereo music widener, wherein blocks 201 and 202 are electronic filters (analog or digital). The signals $L_i$ and $R_i$ are the left and right input signals, respectively, and $L_o$ and $R_o$ their corresponding output signals sent to loudspeakers (not shown in FIG. 2).

Figure 3:
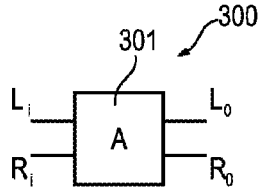

FIG. 3 shows a more abstract scheme 300 of the scheme 200, wherein A is given by the following equation:

$$A = \begin{pmatrix} H_1 & H_2 \\ H_2 & H_1 \end{pmatrix}$$

In other words, the scheme 300 of FIG. 3 shows an abstract version of the set-up of FIG. 2, namely of a stereo music widener.

A block 301 may denote a manipulation unit adapted to selectively manipulate the input signals $L_i$ and $R_i$ to generate the output signals $L_o$ and $R_o$.

Figure 4:
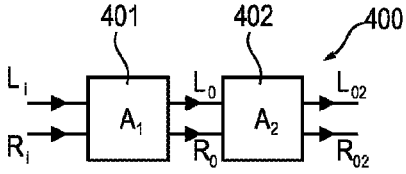

In such a conventional system, a problem may arise if stereo signals have been widened already, see scheme 400 shown in FIG. 4.

Such a previous widening may be performed in a TV studio, on a CD, any other storage medium, or transmission channel, and may be schematically illustrated with a widener unit 401 of FIG. 4, denoted by A1. A further widener unit 402 may be used again, for instance in an (for instance portable) audio set or TV set, denoted by A2 in FIG. 4.

Figure 5:
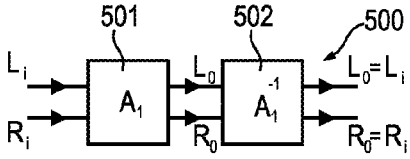

FIG. 5 shows a scheme 500 in which widening is performed by a widening modification unit 501, and is undone by an inverse widening modification unit 502. Therefore, the output signals $L_o$ and $R_o$ are identical to the input signals $L_i$ and $R_i$ in FIG. 5.

It may be possible to change the order of blocks 501 and 502 in FIG. 5, that is to say to first manipulate the audio signal by the inverse widening modification unit 502 before supplying the manipulated audio signal to the widening modification unit 501. The blocks 501 and 502 may have the property to provide an identical output signal regardless of their order in the signal processing path.

Figure 6:
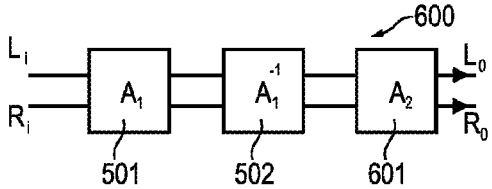

FIG. 6 shows a scheme 600 in which, in addition to the widening modification unit 501 and the inverse widening modification unit 502, an additional widening modification unit 601 is provided.

Therefore, the functions of the units 501 and 502 compensate each other, so that, efficiently, only a manipulation of the additional widening modification unit 601 occurs.

In other words, FIG. 4 shows cascading, FIG. 5 shows undoing, and FIG. 6 shows altering of stereo music wideners.

When wideners are used in tandem, undesirable cascading of those building blocks may occur. Cascading of those wideners is generally an undesired situation, resulting in a poor audio quality. Therefore, exemplary embodiments of the invention detect the widening and compensate it, or, to inhibit the next widener, resulting in a much better sound quality. When some TV broadcasters widen their signal much more than others, this may be annoying even without a cascaded second widener since the sound image changes during channel switching (zapping) in a disturbing way.

According to an exemplary embodiment of the invention, the widening is altered, for instance by completely undoing of the widening, see FIG. 5. The matrix $A_1^{-1}$ denotes the inverse of $A_1$, resulting in that the outputs are equal to the corresponding inputs ($L_o$=$L_i$ and $R_o$=$R_i$). In this case one may say that the widening is undone. It should be kept in mind that the music in a CD can be widened, in a CD recording studio, by $A_1$, wherein in the CD player or any reproduction device is undone by $A_1^{-1}$.

Another application according to an exemplary embodiment is to alter the widening into another widening effect. It is possible to use the set-up of FIG. 6, so that undoing and then altering it by applying a new widening $A_2$ is performed. If desired, the last two procedures can be combined.

FIG. 5 shows an embodiment in which a previously performed widening is undone. In this case, the widening is fully undone, so the user herself or himself can decide to apply widening $A_2$, as depicted in FIG. 6.

The matrix $A_1^{-1}$ for the Incredible Sound case is calculable easily. The coefficients of the corresponding filters of $A_1^{-1}$ are then known and appear to be stable and reliable.

Figure 7:
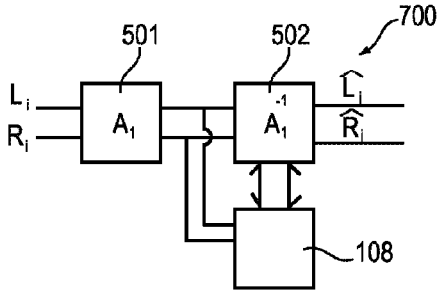

FIG. 7 shows an audio data processing scheme according to an embodiment of the invention.

The block 108 of the device for processing audio data 700 of FIG. 7 according to an exemplary embodiment is capable to perform a blind separation algorithm and is known in the art as such. In a simple embodiment it needs to be detected only whether there is a widening (done by $A_1$) or not. In the former case, the widening may be undone by $A_1^{-1}$, in the latter case there is done nothing.

In a more refined embodiment, as discussed below, the widening may be performed in a parameterized version, with a parameter $\alpha$. Then the block 108 can determine a and calculate $A_1^{-1}$ which solution is parameterized by parameter $\alpha$. In this context, reference is made to the last but one equation of this description (see below), and in an even more efficient way by the two equations preceding this last but one equation and using the right panel of the below mentioned FIG. 9.

FIG. 7 shows the undoing of the widening of $A_1$ by its reverse $A_1^{-1}$, which may be controlled by the blind separation block 108. The output signals $L_i$ and $R_i$ are resembled as close as possible to the input signals $L_i$ and $R_i$. In an Incredible Sound implementation this appears to be perfectly possible.

In the following, details will be explained as to how the blind separation block 108 may work in detail. There are different embodiments possible:

i) It may be possible to assume that the left and right signals are independent, that it is a classical blind source separation problem (see for instance Hiroshi Sawada, Ryo Mukai, Shoko Araki, Shoji Makino "A Robust and Precise Method for Solving the Permutation Problem of Frequency-Domain Blind Source Separation", IEEE TRANSACTIONS ON SPEECH AND AUDIO PROCESSING, VOL. 12, NO. 5, SEPTEMBER 2004, pages 530 to 538). It may seem odd to do this assumption, but in a more refined embodiment it is possible to take only portions of the signal where the assumption is true. Furthermore, with blind source separation it may be desired to separate the signals, but embodiments of the invention may desire to separate, (un)widen and mix again, and this may relax the problem very much. In a simple embodiment the (un)widen filters are known, so it may be sufficient to only estimate the widening factor $\alpha$, the amount of (un)widening, and this may also relax the problem considerably.

ii) It is possible to assume that the signals are correlated, which may be very close to a reality situation. Furthermore, it is possible to consider only parts in time of the signal where this is the case. Then by measuring the phase difference of the output signal—which may increase due to the widening—it may be possible to estimate the amount of widening, and hence undo it.

iii) It is possible to combine i) and ii).

A practical method is to measure the correlation between the output signals and assume if the correlation is about −1 that $\alpha$ is equal or close to one. And if the correlation is modest (as for normal audio) then a may be close to or equal to zero. By letting the operation widen and unwiden operate on the sum and difference signals, rather than the signals itself, the mixing systems may get very simple. Then, a matrix may be obtained with only filters on the diagonal, rather than a full matrix as shown in FIG. 1 of the above cited article of Sawada et al., so the whole separation problem may get much more simpler then the full problem as considered in the included article.

In conclusion, as also the article of Sawada et al. shows, the discussed partial problem is solved in the prior-art, while embodiments of the invention may deal with a much simpler case: filters are known (mixing system is known), but only the amount of mixing ($\alpha$) is unknown.

The "unwidener" may be placed in a second device that receives as input signal the output signal ($L_o$, $R_o$) of a first device. So the first device may be actually remote from the second device. When no information is available of the $A_1$ of the first device, it may be called blind separation.

Figure 8:
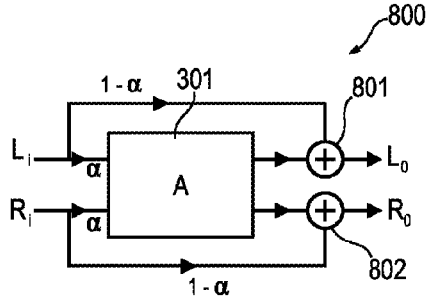

The widener can be made variable or parameterized by the modification of FIG. 3 into FIG. 8, by parameter $\alpha$. If $\alpha$=1, then FIG. 8 is equivalent to FIG. 3, and the output is equal to the input.

The device 800 according to FIG. 8 further has a first adder unit 801 and a second adder unit 802.

In other words, FIG. 8 shows a generalization of the widener of FIG. 3 with the parameter $\alpha$. If $\alpha$=1, then it is equivalent to FIG. 3, if $\alpha$=0, then the output is equal to the input.

This can be written as the following equation, where, for brevity, the same A is used, whereas it is the parameterized version of the one of the above first equation:

$$A = \begin{pmatrix} \alpha H_1 + (1-\alpha) & \alpha H_2 \\ \alpha H_2 & \alpha H_1 + (1-\alpha) \end{pmatrix}$$

Instead of working with filters $H_1$ and $H_2$ (see FIG. 2), a more efficient possible implementation of the widening and the undoing is possible. The former is depicted in FIG. 9, showing a device 900 according to an exemplary embodiment of the invention.

Figure 9:
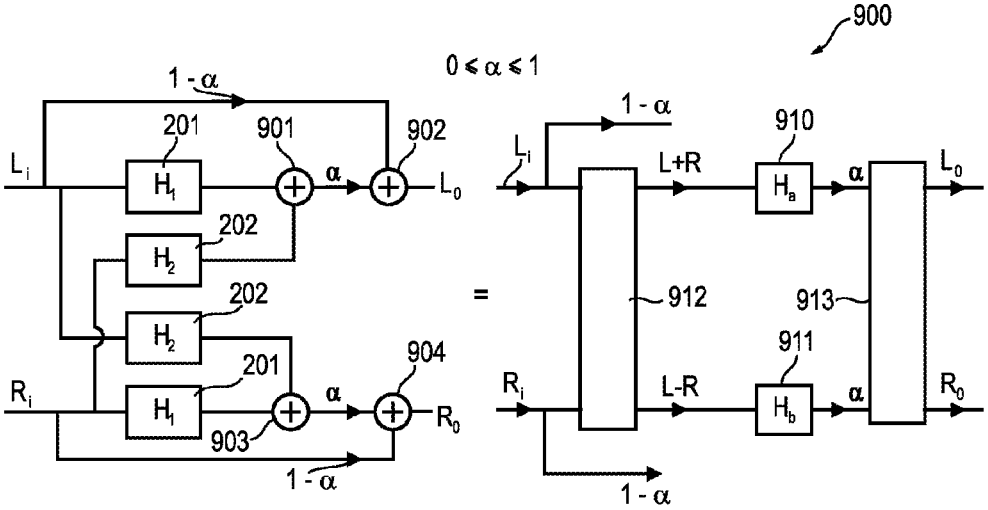

FIG. 9 denotes the right panel (for clarity the paths denoted with "1-$\alpha$" like the left panel is left out).

At the left set-up, first the sum and difference signals are determined. There are two filters $H_a$ and $H_b$ operating onto the sum and difference signals. Then those signals are again summed and subtracted, to obtain finally the parameterized output signals $L_o$ and $R_o$. The left scheme of FIG. 9 is fully equivalent to the right scheme.

Adding units are denoted with reference numerals 901 to 904. The blocks $H_a$ and $H_b$ are denoted with reference numerals 910 and 911. Furthermore, sum/difference blocks 912 and 913 are provided.

An advantageous embodiment of the invention is to use the right panel of FIG. 9. To undo the widening, it is possible to have inverse filters of $H_a$ and $H_b$, which may be denoted as $H_x$ and $H_y$, respectively.

This is shown in the following equations. In these cases it is sufficient—thanks to the symmetry of matrix A—only two filters, $H_a$ and $H_b$ and two for their inverse $H_x$ and $H_y$ respectively.

$$H_a = \frac{H_1 + H_2}{2}$$

$$H_b = \frac{H_1 - H_2}{2}$$

$$H_x = \frac{1}{\alpha H_a + (1-\alpha)}$$

$$H_y = \frac{1}{\alpha H_b + (1-\alpha)}$$

$$A^{-1} = \Delta^{-1}\begin{pmatrix} \alpha H_1 + (1-\alpha) & -\alpha H_2 \\ -\alpha H_2 & \alpha H_1 + (1-\alpha) \end{pmatrix}$$

where $\Delta = (\alpha H_1 + (1-\alpha))^2 + (\alpha H_2)^2$.

In conclusion, the block 108 may estimate α, and because $H_a$ and $H_b$ are known (the coefficients are known), the filters $H_x$ and $H_y$, given by the above equations, are known as well. To avoid the division in these two equations for calculating $H_x$ and $H_y$, the filters $H_x$ and $H_y$ can be calculated in a recursive way.

In the case $H_1$ and $H_2$ or $H_a$ and $H_b$ are not known, it is even possible to calculate the inverse of A.

In case that the signal was not widened then it is still possible to use the inverse of A, doing this a stereo narrower may be obtained.

It is clear that the example of a 2×2 matrix is easy to generalize to an n×m matrix, for instance for a 5-channel system, a 5×5 matrix is present. In this case it may be possible to widen or undo the widening at the front channels and the rear channels in an independent way.

In the following, referring to FIG. 10, a phase difference calculation scheme in the context of a blind estimation of the parameter α according to an exemplary embodiment of the invention will be explained. The value of α can be modified between 0 and 1. The value 0 denotes no stereo widening and the value 1 means that the output signal only consists of the widened signal. Any value between 0 and 1 means that the output signal is a mixture of the original stereo signal and the filtered signal. In practice the value of a will be between 0 and 1. In case that all system characteristics are known—except the amount of widening α-, then α needs to be detected to make an inversion of this system. The determination of α is a blind identification problem. The original audio signals may be unknown to the system. Moreover, according to exemplary embodiments, the input signals should not be considered to be independent. In order to estimate α, the following considerations may be made.

The phase difference of audio signals may be similar to that of jointly distributed noise signals. In order to compare audio signals with noise signals, a quantitative measurement for the distribution functions may be advantageous. The distribution of both audio and noise signals may be more or less symmetric, so the mean of the difference may be about zero. This means that the variance or the standard deviation, the square root of the variance, can easily be taken as a measurement for the density function. Despite the similarity between the jointly distributed noise sources and audio signals there is one problem to quantify α. The problem is that the degree of dependence may differ per audio fragment and may have influence on the slope angle. This means that α may be not directly correlated to the steepness of the slope.

A table may be used to determine the widening factor α. As an alternative to a table, the scheme of FIG. 10 may be implemented. The system is based on the assumption that an angle of a slope of a first order approximation of the variance may be equal to zero in an unfiltered case. The purpose of the system is to control the slope angle towards zero. The method of finding the angle of the slope μ of the first order approximation may be performed based on a first order polynomial fit.

Figure 10:
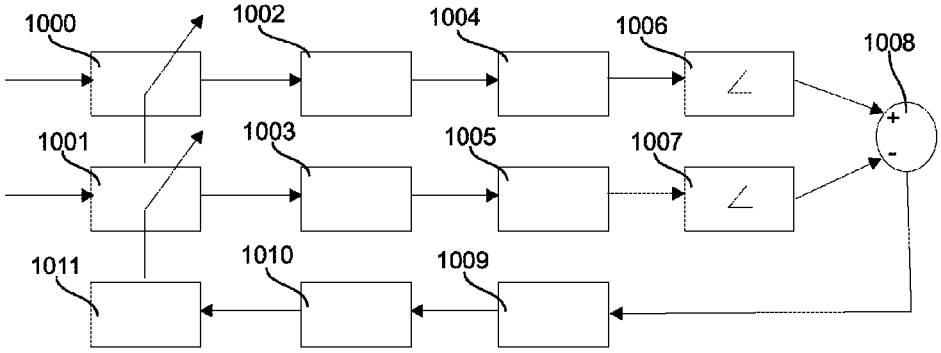
FIG. 10 illustrates a phase difference calculation scheme according to an exemplary embodiment of the invention.

The system of FIG. 10 first filters a block of the input signal (supplied to inputs of filter units 1000, 1001) with the inverse widening system with the latest widening factor α supplied by an update block 1011. Then it calculates the phase difference for this block on the basis of units 1002 to 1008. The result of this is provided at an output of the unit 1008 and is put in a buffer 1009 of arbitrary length. If this buffer 1009 is full, the angle of the slope is calculated. Then the value of the widening factor α is updated $$\alpha := \alpha - \mu$$

using an angle detection unit 1010 and the update block 1011.

In FIG. 10, a filter block 1000, a filter block 1001, a window block 1002, a window block 1003, a Fast Fourier Transformation block 1004, a Fast Fourier Transformation block 1005, a processing block 1006, a processing block 1007, a combination unit 1008, a buffer 1009, an angle detection block 1010, and a widening factor update block 1011 are shown.

It should be noted that the term "comprising" does not exclude other elements or features and the "a" or "an" does not exclude a plurality. Also elements described in association with different embodiments may be combined.

It should also be noted that reference signs in the claims shall not be construed as limiting the scope of the claims.

The invention claimed is:

1. A device for processing an audio signal, comprising:

a detection unit adapted for detecting a widening state of the audio signal, wherein the detected widening state is indicative whether or not the audio signal has previously been widened or narrowed to obtain an altered stereo effect from its initial or original shape of stereo and mono components before the audio signal has been supplied to the device; and a widening modification unit adapted for modifying a widening characteristic of the audio signal depending on the detected widening state of the audio signal.

2. The device according to claim 1, wherein the detection unit is adapted for detecting a widening parameter indicative of a degree to which the audio signal has previously been widened or narrowed.

3. The device according to claim 1, wherein the detection unit is adapted for detecting the widening state of the audio signal based on a blind separation algorithm.

4. The device according to claim 1, wherein the detection unit is adapted for detecting the widening state of the audio signal based on a calculation of a phase difference between components of an audio signal.

5. The device according to claim 1, wherein the detection unit is adapted for detecting the widening state of the audio signal based on an iterative procedure.

6. The device according to claim 1, wherein the detection unit is adapted for detecting the widening state of the audio signal based on information of at least one of the audio signal itself and external information.

7. The device according to claim 1, wherein the widening modification unit is adapted for widening or narrowing the audio signal in a manner to at least partially, particularly to completely, undo a previously performed widening or narrowing when the detected widening state indicates that the audio signal has previously been widened or narrowed.

8. The device according to claim 1, wherein the widening modification unit is adapted for altering a widening or narrowing of the audio signal when the detected widening state indicates that the audio signal has previously been widened or narrowed.

9. The device according to claim 1, wherein the widening modification unit is adapted for inhibiting the audio signal from widening or narrowing when the detected widening state indicates that the audio signal has previously not been widened or narrowed.

10. The device according to claim 1, wherein said device further comprises a further widening modification unit for widening or narrowing the modified auto signal have been processed by the widening modification unit.

11. The device according to claim 1, wherein the widening modification unit comprises a filter.

12. The device according to claim 1, wherein the widening modification unit is adapted to perform, selectively, one of the group consisting of stereo widening and stereo narrowing.

13. The device according to claim 1, comprising a plurality of audio playback devices adapted to play back the processed audio signal.

14. The device according to claim 1, wherein the audio signal is a multiple audio channel signal, particularly a stereo signal.

15. The device according to claim 1, realized as at least one of the group consisting of a portable audio player, a loudspeaker, an audio surround system, a mobile phone, a headset, a loudspeaker, a hearing aid, a handsfree system, a television device, a TV set audio player, a video recorder, a monitor, a gaming device, a laptop, an audio player, a DVD player, a CD player, a harddisk-based media player, an internet radio device, a public entertainment device, an MP3 player, a hi-fi system, a vehicle entertainment device, a car entertainment device, a medical communication system, a body-worn device, a speech communication device, a home cinema system, a home theater system, an audio server, an audio client, a flat television apparatus, an ambiance creation device, and a music hall system.

16. A method of processing an audio signal in a device, comprising:

detecting a widening state of the audio signal, wherein the detected widening state is indicative whether or not the audio signal has previously been widened or narrowed to obtain an altered stereo effect from its initial or original shape of stereo and mono components before the audio signal has been supplied to the device; and modifying a widening characteristic of the audio signal depending on the detected widening state of the audio signal.

17. A non-transitory computer-readable medium, in which a computer program of processing an audio signal is stored, which computer program, when being executed by a processor, is adapted to carry out or control a method according to claim 16.

18. A program element of a non-transitory computer-readable medium of processing an audio signal, which program element, when being executed by a processor, is adapted to carry out or control a method according to claim 16.

* * * * *